United States Patent [19]

Cheney

[11] 4,266,827

[45] May 12, 1981

[54] INCOMPRESSIBLE FLUID TYPE ROCK BREAKER

[76] Inventor: Alwyn H. Cheney, 84 Valley View Dr., Highbury, Australia

[21] Appl. No.: 84,172

[22] Filed: Oct. 12, 1979

[30] Foreign Application Priority Data

Oct. 16, 1978 [AU] Australia ..... PD6384

[51] Int. Cl.[3] ..... E21C 37/12

[52] U.S. Cl. ..... 299/20; 102/333; 166/177; 299/16

[58] Field of Search ..... 299/16, 20–23; 102/30; 166/139, 177; 405/259, 260; 175/210, 230; 52/161

[56] References Cited

U.S. PATENT DOCUMENTS

| | | | |
|---|---|---|---|
| 1,503,420 | 7/1924 | Hutton | 102/30 X |
| 1,582,273 | 4/1926 | Joy | 299/16 |
| 1,710,486 | 4/1929 | Morgan | 299/16 X |
| 2,211,243 | 8/1940 | Meyer | 299/16 |
| 4,146,094 | 3/1979 | Benedum et al. | 166/139 X |

FOREIGN PATENT DOCUMENTS

| | | | |
|---|---|---|---|
| 660979 | 11/1951 | United Kingdom | 52/161 |

*Primary Examiner*—Ernest R. Purser
*Attorney, Agent, or Firm*—Haseltine and Lake

[57] ABSTRACT

A rock breaker comprising a tool insertable in a hole in a rock and fed through a supply line with an incompressible liquid to maintain a column of the liquid in the hole, and means to apply to the liquid a shock means sufficiently high to fracture the rock, the tool comprising a hollow stem having an expansible collet and a resilient sealing ring and mechanical means to expand the collet and ring.

12 Claims, 6 Drawing Figures

INCOMPRESSIBLE FLUID TYPE ROCK BREAKER

FIELD OF THE INVENTION

This invention relates to an improved rock breaker and in particular it relates to a breaker of a type which uses pressure fluid to fracture rocks or similar fracturable materials.

BACKGROUND OF THE INVENTION

The reason why various forms of apparatus have been suggested for fracturing rocks is to be able to provide a means which, unlike an explosive, will cause fracture but will not cause the material to be projected from the site. Amongst earlier attempts to fracture materials in this way reference can be had to U.S. Pat. No. 4,123,108 in the name of Eric V. Lavon in which a material such as rock is broken by forcing a longish mass body of relatively incompressible fluid, such as water, against the material to be broken, or U.S. Pat. No. 4,141,592 also in the name of Eric V. Lavon in which the rock is broken by maintaining a column of relatively incompressible fluid in a tube the inner end of which is inserted in a predrilled hole in the rock and then generating pressure in the column by means of a piston applied to the tube outside of the hole, which pressure is transmitted through the column to the fluid in the hole.

It has also been proposed in Australian Pat. No. 163,489, Imperial Chemical Industries Limited, to fill a hole drilled into rock or the like with an incompressible liquid and to then use an explosive to provide a shock wave in the material.

Reference is also to be had to Australian Pat. No. 500,571 filed by myself on the 3rd December, 1974 which was designed specifically to use a fracture method in which a shock wave was applied to an incompressible liquid sealed in a hole drilled into a rock or the like which is to be broken. An object of that invention was to achieve safety by preventing the force generated to fracture the rock from hurling fragments of the rock for a considerable distance as is the case in blasting or the like, and this object was achieved by providing apparatus which can be sealed into the hole sufficiently securely to avoid ejection of the device when the shock is applied and at the same time to cause fracture by the shock applied to the rock or other fracturable material. That earlier device utilized a tool which was both anchored in a hole drilled in the rock or the like and which was provided which sealing means to prevent egress of fluid placed under pressure in the hole.

It was known prior to my earlier invention referred to above to use a tool which could be sealed in a hole drilled in the materials to be fractured and reference can be had to U.S. Pat. No. 2,840,360 in the name of Jean Jerusel which utilized a series of expansible resilient rings between sections of the tool and the wall of the hole to prevent high pressure liquid such as water injected into the hole for mining purposes from leaking from the hole, but my earlier invention varied from this by using both a split collet and resilient sealing means, the split collet being expanded in the rock to prevent withdrawal of the tool and the resilient sealing means being compressed to form a tight junction with the wall of the hole to ensure that liquids cannot bypass the tool.

In my invention both of these members were hydraulically actuated in an independent manner and while satisfactory for the purpose it is the object of the present invention to provide an improved form of tool of simple construction which can be readily inserted into a hole drilled into a rock or fracturable member, which can then be locked therein to completely seal the hole, and which can readily be released after use, the present invention avoiding the need to use pressure fluid to actuate the holding collet and the liquid seal.

The device according to this invention thus comprises a tool which is adapted to be connected to a liquid pressure supply firstly to fill a hole in which the tool is inserted and secondly to apply the necessary high pressure shock to the fluid to fracture the rock, the tool comprising a hollow stem with a tapered section at its remote end and means at the other end to connect the liquid supply, the hollow stem having on it a collet which is split so that it can be expanded when relative movement between the stem and the collet takes place, the pressure to expand the collet being obtained by using a member which engages a thread on the stem and draws the stem upwardly in relation to the collet, a sleeve extending from the top of the collet around the stem to be engaged by the thread operated means to hold the collet in position when the stem is moved upwardly in the sleeve.

The stem is also encircled by a resilient sealing member which is so arranged that it can be compressed either by being positioned between the collet and the aforesaid sleeve or it can be compressed independently by a further sleeve encircling the first sleeve and provided with means such as a screw thread on the first sleeve and a nut engaging the second sleeve to allow the seal to be compressed.

PREFERRED CONSTRUCTION

Figure 1:
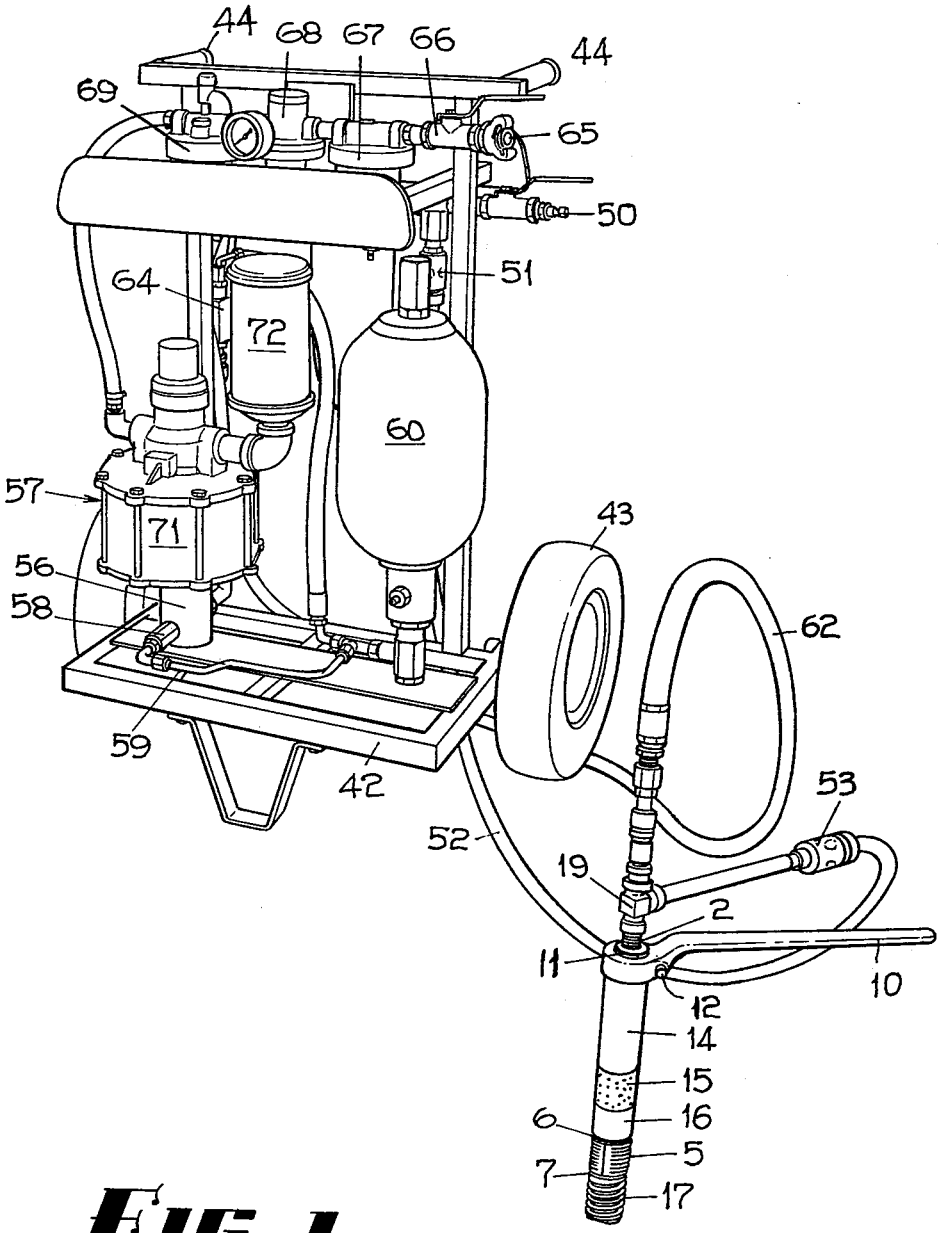
FIG. 1 is a perspective view of a unit constructed according to the invention showing a portable power unit for filling the hole with water and for providing the necessary shock to cause fracture of the rock, the tool being shown connected to the power unit so that this tool can be inserted in a hole drilled in a rock which is to be fractured.
Figure 2:
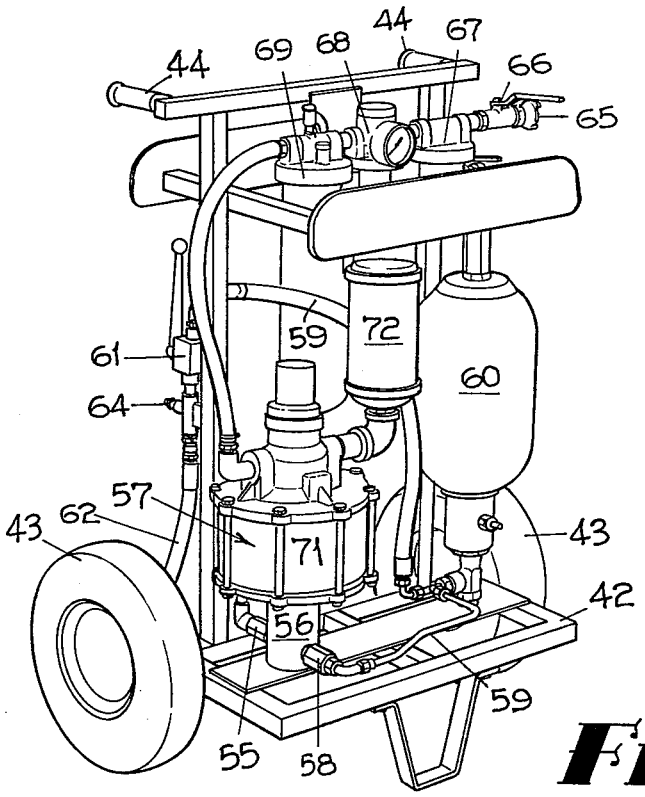
FIG. 2 is a perspective view of the power unit from a different angle.
Figure 3:
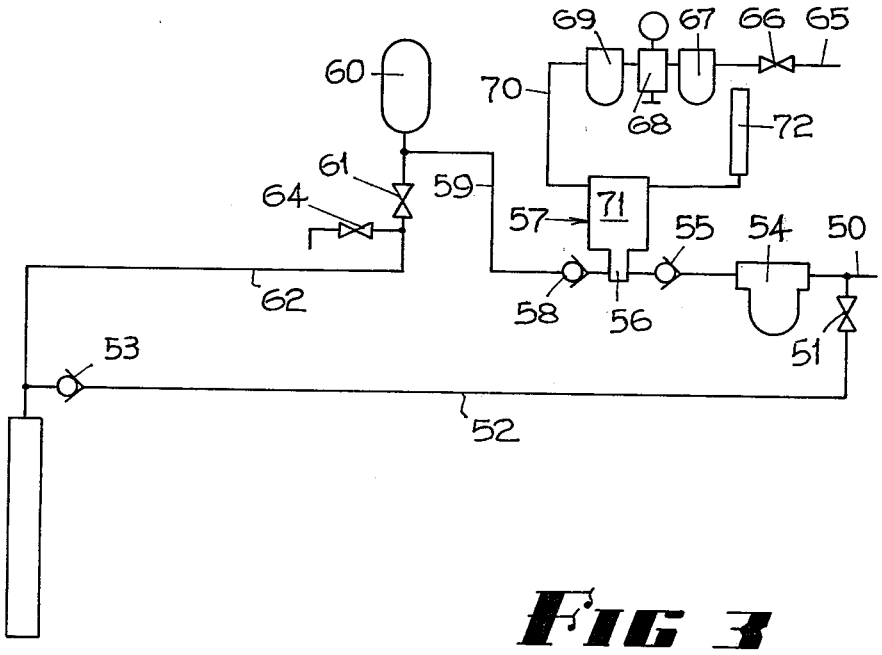
FIG. 3 is a schematic view showing how the power unit is connected to the liquid supply, showing also the accumulator and mechanism for supplying the shock force.
Figure 4:
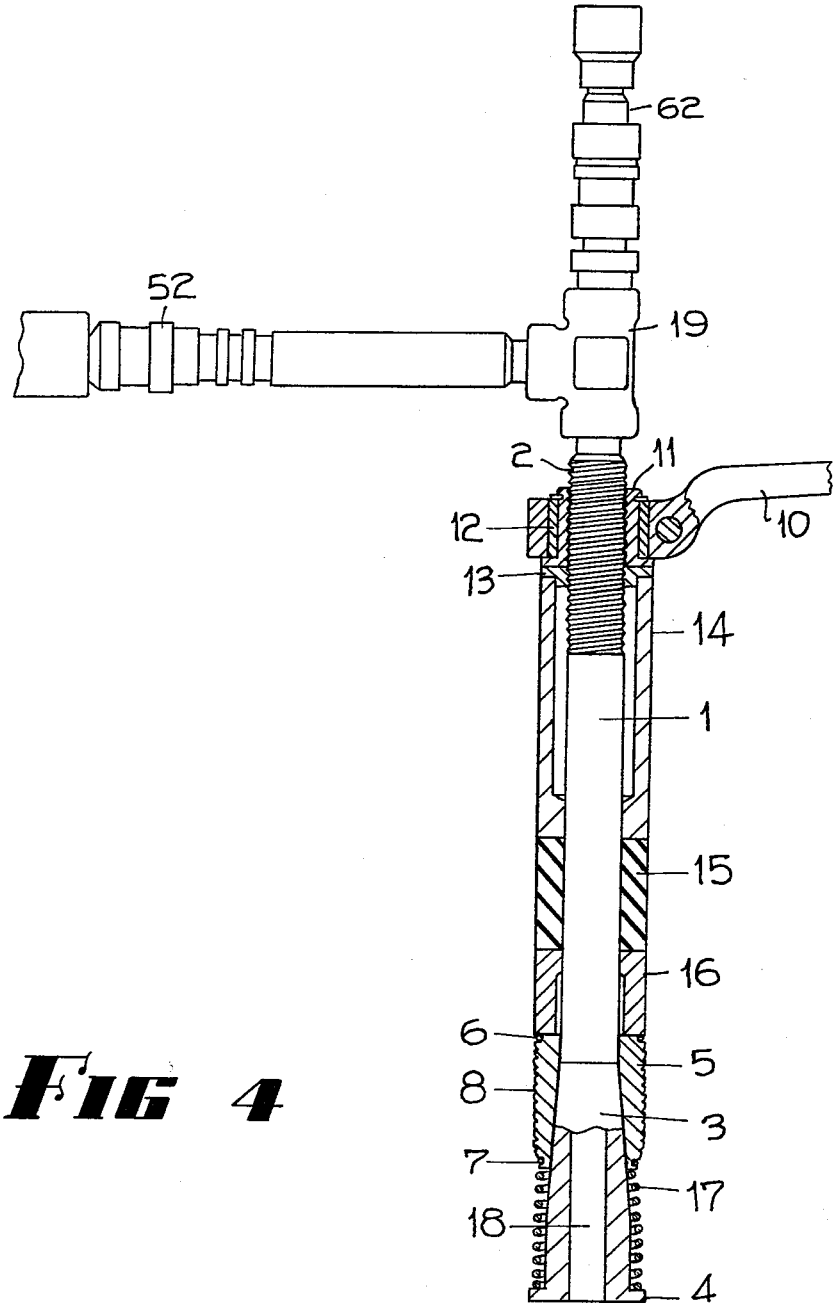
FIG. 4 is a view of the simplest form of the tool showing the parts in a position where the tool is ready to be inserted into a hole drilled in the rock or like fracturable material.
Figure 5:
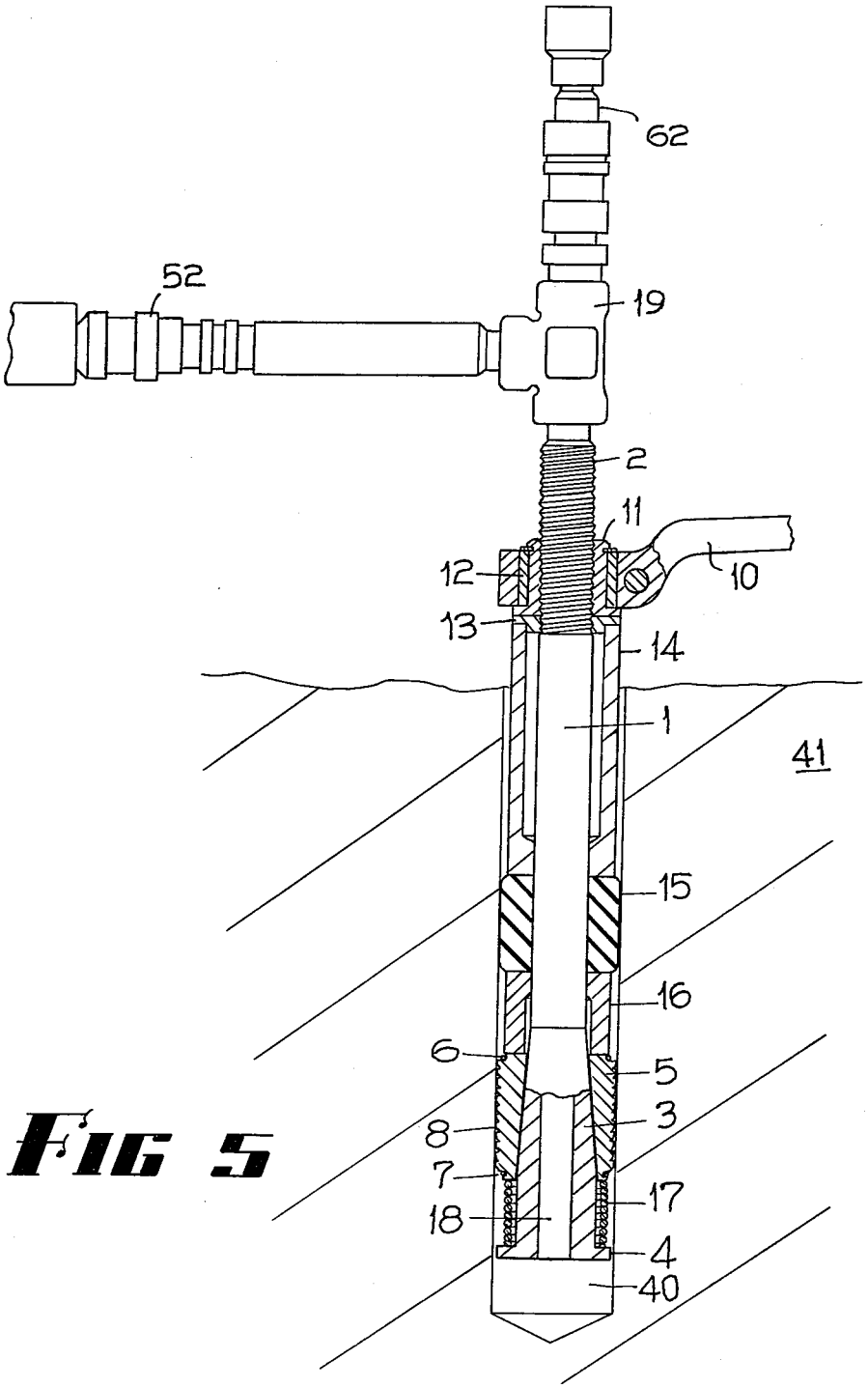
FIG. 5 shows the tool actually inserted into the rock with the collet tightened and the seal expanded in readiness to apply the liquid to the hole.

Referring first to the tool which is inserted into the hole in the rock or like fracturable material which is to be split, this comprises a hollow stem 1 having at its top a screw threaded portion 2 and at its other end, which is the lower end when inserted into a hole, a tapered portion 3 which has a flange 4 at its end, and this stem carries on it the split collet 5 which is formed in two halves held together by circlips 6 and 7 one at each end of the collet, the collet having on it a series of saw-tooth ridges 8 which can be forced tightly against the rock to ensure that the collet cannot be dislodged outwardly when pressure exists within the hole.

The hollow stem 1 is moved upwards in relation to the collet 5 when it is desired to expand the collet. This is achieved by manipulating a handle 10 which has on it a nut 11 which engages the threaded portion 2 of the stem 1, through a ratchet 12 and disposed between the nut 11 and the top of collet 5 are a series of members, the first being an antifriction ring 13 engaging a sleeve 14 which at its lower end engages the upper edge of an expansible sealing member 15, the lower end of the sealing member 15 being engaged by a spacer 16 which rests on the top of the collet 5, the assembly being such that when the nut 11 is rotated on the stem 1, the assembly between it and the collet 5 applies a compressive force on the sealing member 15 to force the material into tight contact with the wall of the hole in which the tool is positioned, at the same time forming a restriction against upward movement of the collet so that as the stem 1 is drawn upward by the nut 11 moving on the screw threaded portion 2, the collet 5 is expanded to firmly engage the wall of the hole due to the tapered portion 3 of the stem moving into the collet to urge the two parts thereof outwardly.

A spring 17 encircles the lower part of the stem 1 between the flange 4 and the bottom of the collet 5 so that, when it is desired to remove the device from the hole, the stem 1 will be drawn downwards by the spring 17 to collapse the collet 5 and at the same time, because the pressure is removed which was applied to the sealing member 15, allowing the sealing member to return to its unexpanded form to release the tool from the hole. The hollow of the stem is designated 18 and extends axially right through the stem to open into a connector 19 at the top of the stem.

Figure 6:
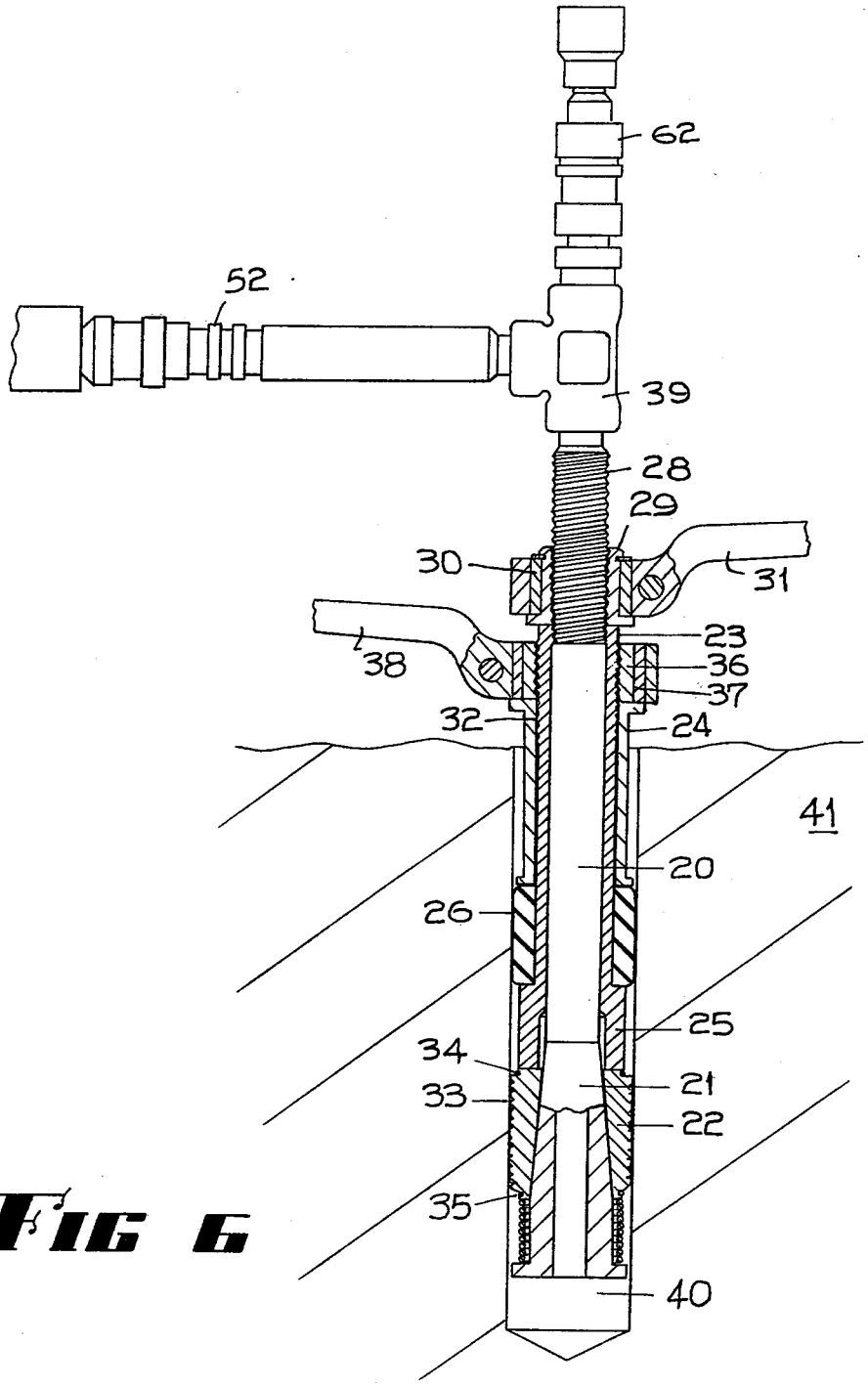
FIG. 6 is a view of a modified form in which expansion of the collet and expansion of the seal are effected independently instead of by means of a single adjustment member as shown more particularly in FIGS. 4 and 5.

According to the modification shown in FIG. 6, the main stem 20 has at its lower end a tapered section 21 encircled by a split collet 22 so arranged that the collet 22 can be expanded to firmly lock the rock breaker in a hole by pulling the main stem 20 upwardly while leaving the collet 22 in position, the main stem 20 in turn being encircled by a sleeve 23 which engages the top of the collet 22 and the upper end of which is encircled by a further sleeve 24 which fits around the first sleeve 23 and extends to near the top of it. The first sleeve 23 has on it between the sleeve 24 and an expanded part 25 at its lower end a resilient sealing ring 26, the expanded end 25 of the first sleeve 23 engaging the top of the split collet 22.

The compression of the sealing ring 26 is effected by forcing it on to the expanded portion 25 of the first sleeve 23 by means of the sleeve 24 which encircles the secondary stem 25.

The main stem 20 has at its top a screw threaded section 28 which is engaged by a collet tightening nut 29 and this nut 29 bears on the first sleeve 23 which in turn engages and holds the collet 22 in place when the collet tightening nut 29 is manipulated to force the main stem 20 upwardly by reaction against the first sleeve 23, to thereby expand the collet by means of a tapered lower section 21 of the stem 20 to lock the collet firmly in position in the hole in the rock. The collet tightening nut 29 is rotated through a ratchet 30 by a handle 31.

The split collet 22 again has a number of sawtooth ridges 33 around it so arranged that they bite into the rock face when the pressure is exerted to prevent the collet from being moved upwardly and to thereby firmly lock the rock breaker in position against ejection from the hole when the pressure is applied. The split collet is held together by circlips 34 and 35.

To compress the sealing ring 25, a seal tightening nut 36 engages a threaded portion 32 on the upper part of the first sleeve 23 so that when the nut 36 is wound downwardly to force the sleeve 24 down on to the sealing ring 25, this sealing ring 26 is compressed to form an effective high pressure seal at this locality.

The nut 36 is rotated through a ratchet 37 by a second lever 38.

This assembly results in a simple arrangement which merely requires a split collet 22 to be assembled on the main stem 20 in contact with a tapered section 21 thereof and to then place the first sleeve 24 into position, which engages the top of the collet 22, which in turn engages the collet tightening nut 29 so that when this nut is manipulated the collet will engage firmly on the rock but this action does not necessarily affect the position of the sealing ring 26 which in turn is placed over the first sleeve 24 which has at its upper end the threaded portion 32 and is engaged by the seal tightening nut 36 so that the nut 36 forces the sleeve 24 down on the first sleeve 23 to firmly compress the sealing ring 26.

In this way, by simply manipulating the collet tightening nut 29 through the lever 31, and then the seal tightening nut 36 when the device has been assembled in a hole, the device is locked against ejection by the expanded split collet 22 and when the nut 36 is screwed down liquid is prevented from being lost from the hole by the sealing ring 26 engaging the wall of the hole in the rock to prevent leakage from beneath the tool.

A junction 39 is again positioned at the top of the hollow stem 20 to allow a column of water to be supplied to the hollow stem. In both of the forms of the tool described above, the tool is inserted in a bore hole 40 in a rock 41 or other member to be fractured, and when high pressure liquid is applied, the rock will be fractured.

The mechanism for applying the operating pressure to the tool is shown mounted on a frame 42 mounted on wheels 43 and provided with handles 44 to allow the unit to be conveyed.

The mechanism for applying the pressure comprises a water line 50 which leads through a flow control valve 51 to a line 52 which in turn joins to the junction 19 or 39 of the tool to allow a flow to take place into the bottom of the hole 40 in the rock 41, a check valve 53 being included in the line as well as the control valve 51.

Water also flows through a filter 54 through a check valve 55 to the high pressure cylinder 56 of an intensifier 57 and from this through a check valve 58 and line 59 to an accumulator 60 which has in it a gas filled bag in usual manner. Pressure water from the accumulator 60 passes through a quick release trigger valve 61 which is arranged to allow a sudden flow of water through this valve when it is opened, water flowing from the valve 61 through the line 62 to the junction on the hollow stem to apply water pressure to the hole.

A bleed valve 64 allows the line 62 up to the trigger valve 61 to be filled with water so that when initially filling the hole 40 with water the column of water extends from the hole right up to the valve 61 so that when the valve is open, pressure from the accumulator 60 is suddenly released to place a shock loading on to the water in the pressure line 62 and the water within the hole 40, back-flow along the line 52 being prevented by the one-way valve 53.

The intensifier can be of usual type and is shown as air-operated, air flowing through the line 65 and valve 66 to a water trap 67, a regulator valve 68 and a lubricator 69 the air then passing through the line 70 into the large cylinder 71 of the intensifier 57 to operate a large piston in cylinder 71 of the intensifier to in turn actuate a small piston in the cylinder 53 in the intensifier whereby to provide the high pressure water for effecting a fracture. Air from the intensifier is exhausted through the muffler 72. Intensifiers and their onstructions are well known in the art.

I claim:

1. A rock breaker for fracturing rock or other fracturable material comprising:

a portable frame having on its means to receive liquid from a source of supply, a pressure intensifier on the said frame connected to the said liquid supply, and accumulator also on said frame connected to said intensifier to compress a gas in the said accumulator when liquid under pressure is fed from the said intensifier to the said accumulator, a tool insertable in a hole in the said rock or fracturable material, a flexible high-pressure line connecting the said accumulator with the said tool, means to bleed air from the said line, a quick release valve in the said high-pressure line, a further flexible lower-pressure line placing into communication the said liquid source and the said pressure line between the said valve and the said tool, a non-return valve in the said further line at the said pressure line, the said tool comprising a hollow stem having at a first end portion means to engage at least the said pressure line to feed liquid through the said hollow stem into the said hole, and actuating means for holding and sealing the said tool in the said hole, said holding and sealing means comprising an expansible collet on the said stem at a second portion thereof and a resilient expansible sealing member encircling the said stem, whereby when in use, the said tool is locked in the said hole when the said collet is expanded and said hole is sealed against egress of liquid therefrom past the said tool when the resilient sealing member is expanded, and the said hole has a column of liquid maintained in it by supply from the said further line through the said non-return valve, and the rock or fracturable material is split when the said liquid has high pressure applied to it from the said accumulator through the said high pressure line and the said tool.

2. A rock breaker according to claim 1 wherein the said tool comprises:

a hollow stem having at one end portion a thread and means to allow liquid to be fed through the said hollow stem into the said hole, an expansible collet encircling the said hollow stem toward its other end, a threaded member engaging the said screw thread on the said stem arranged to be moved axially on the said stem, means on the said hollow stem to expand the said collet, when the said threaded member is moved on the said thread, a resilient expansible sealing member encircling the said stem intermediate the said collet and the said threaded end of the said stem, and means to expand the diameter of the said sealing member by compressing the said sealing member.

3. A rock breaker for fracturing rock or fracturable material comprising:

(a) a tool insertable in a hole in a rock or fracturable material and arranged to be fed through a supply line with an incompressible liquid to maintain a column of the said liquid in the said hole, (b) means to supply liquid at a pressure sufficiently high to fracture the rock or fracturable material, and to suddenly apply the said high-pressure liquid to the said column of liquid in the said hole to fracture the said rock, said tool comprising, (c) a non-rotational hollow stem having at one end portion a thread and means to allow liquid to be fed through the said hollow stem into said hole, (d) an expansible collet encircling a tapered portion on the said hollow stem at the other end remote from the said thread, (e) a threaded driving member engaging the said screw thread on the said stem arranged to be moved axially on the said stem when rotated about the said stem, (f) a sleeve on the said hollow stem to move the said collet to expand the said collet when the said threaded member is moved on the said screw thread, (g) a resilient expansible sealing member encircling the said stem intermediate the said collet and the said threaded end of the said stem, and (h) means to expand the diameter of the said sealing member by compressing the said sealing member.

4. A rock breaker according to claim 3 wherein the said sleeve between the said threaded member and the said collet is transversely divided and has the said resilient sealing member interposed between the two parts of the said so divided sleeve, whereby the said threaded member when moved to expand the said collet through the said sleeve also compresses the said resilient sealing member to expand it.

5. A rock breaker according to claim 3 wherein the said sleeve extends between the said threaded member and the said collet and has an expanded portion at the said collet and has the other end externally threaded, and the said resilient sealing member encircles the said sleeve and engages the said expanded portion, and by a further sleeve encircling the first said sleeve to extend between the said resilient sealing member and a threaded member engaged on the said thread on the first said sleeve whereby the said threaded member when moved toward the said resilient sealing member compresses the said resilient sealing member to expand it independently of movement of the first said sleeve.

6. A rock breaker according to claim 4 or claim 5 wherein the said threaded member, or each said threaded member, includes an extending operating handle, and includes a ratchet mechanism between the extending operating handle and the said threaded member.

7. A rock breaker according to claim 3 wherein the said hollow stem has an outwardly extending flange at the end opposite the said threaded portion, and a compression spring on the said stem confined between the said flange and the said collet, and the said taper increases progressively in diameter toward the said flange, whereby when the said hollow stem is moved in relation to the said collet to expand the said collet the said spring is compressed whereby to urge the said collet back from the larger diameter of the said taper when the said stem is oppositely moved so as to decrease the diameter of the said collet.

8. A rock breaker according to claim 3 wherein the said hollow tube has a connector at the threaded end to attach a pair of supply lines to it, the one supply line being adapted to feed low pressure liquid into the said hollow stem through a non-return valve to maintain the said column of liquid in the said hole, and the other said supply line being adapted to feed high-pressure liquid to the said hollow stem through a quick release valve to momentarily apply the high-pressure to the said column of liquid in the said hole.

9. A rock breaker according to claim 3 wherein the means for supplying liquid to the said hollow stem comprise, a supply line from a liquid source connected to supply liquid through a non-return valve to the said hollow stem, and a supply line to apply high-pressure liquid to the said hollow stem through a quick release valve from an accumulator, a wheeled frame to support the said accumulator, a pressure intensifier also mounted on said wheeled frame and fed from a liquid source, means to cause the intensifier to charge the said accumulator with liquid to compress a gas in a bag in said accumulator to pressurize the liquid sufficiently to fracture the rock or fracturable material.

10. A rock breaker for fracturing rock or other fracturable material comprising:

a portable frame having on it means to receive liquid from a source of supply, a pressure intensifier on the said frame connected to the said liquid supply, an accumulator also on said frame connected to said intensifier to compress a gas in the said accumulator when liquid under pressure is fed from the said intensifier to the said accumulator, a tool insertable in a hole in the said rock or fracturable material, a high-pressure line connecting the said accumulator with the said tool, a quick release valve in the said high-pressure line, a further line communicating with the means which receive liquid from the said source and the said pressure line between the said valve and the said tool, a non-return valve in the said further line at the said pressure line, bleed means on said high-pressure line to allow air to be expelled from said high-pressure line, said tool comprising a hollow stem having at one end portion a thread and means to engage at least the said pressure line to feed liquid through the said hollow stem into the said hole, a collet on the said stem at the other end portion thereof arranged to be expanded by a tapered section of the said stem to lock the said tool in the said hole, a threaded operating member on the said thread on the said stem connected by a sleeve on the said stem, which is interposed between the said threaded member and the said collet whereby to expand the said collet on the said taper when the said operating member is moved in a first direction, a resilient expansible sealing member encircling the said stem, means to expand the said sealing member on the said stem, and a return spring to move the said stem to collapse the said collet and the said expansible sealing member when the said threaded operating member is moved in a direction opposite to the said first direction, whereby the said tool is locked in the said hole when the said collet is expanded and the said hole is sealed against egress of liquid therefrom past the said tool when the resilient sealing member is expanded, and the said hole has a column of liquid maintained in it by supply from the said further line through the said non-return valve, and the rock or fracturable material is split when the said liquid has high-pressure applied to it from the said accumulator through the said high-pressure line and the said tool.

11. A rock breaker according to claim 10 wherein the said sleeve between the said threaded member and the said collet is transversely divided and has the said resilient sealing member interposed between the two parts of the said so divided sleeve, whereby the said threaded member when moved to expand the said collet through the said sleeve also compresses the said resilient sealing member to expand it.

12. A rock breaker according to claim 10 wherein the said sleeve extends between the said threaded member and the said collet and has an expanded portion at the said collet and has the other end externally threaded and the said resilient sealing member encircles the said sleeve and engages the said expanded portion, and by a further sleeve encircling the first said sleeve to extend between the said resilient sealing member and a threaded member engaged on the said thread on the first said sleeve whereby the said threaded member when moved toward the said resilient sealing member compresses the said resilient sealing member to expand it independently of movement of the first said sleeve.

* * * * *